US010040086B2

(12) United States Patent
Ho

(10) Patent No.: US 10,040,086 B2
(45) Date of Patent: Aug. 7, 2018

(54) LIQUID EJECTION DISPENSER

(71) Applicant: La Vendi Inc., Taipei (TW)

(72) Inventor: Sheng-Chin Ho, Taipei (TW)

(73) Assignee: LA VENDI INC., Taipei (TW)

( * ) Notice: Subject to any disclaimer, the term of this patent is extended or adjusted under 35 U.S.C. 154(b) by 0 days.

(21) Appl. No.: 15/379,493

(22) Filed: Dec. 15, 2016

(65) Prior Publication Data

US 2018/0169679 A1 Jun. 21, 2018

(51) Int. Cl.

| | |
|---|---|
| ***B67D 3/00*** | (2006.01) |
| ***B67D 7/06*** | (2010.01) |
| ***B05B 11/00*** | (2006.01) |
| ***B67D 7/02*** | (2010.01) |
| ***B67D 7/42*** | (2010.01) |

(52) U.S. Cl.
CPC ..... *B05B 11/0091* (2013.01); *B67D 7/0205* (2013.01); *B67D 7/42* (2013.01)

(58) Field of Classification Search
CPC ..... B05B 11/0091; B67D 7/0205; B67D 7/42
USPC ..... 222/527, 528, 529, 531, 533
See application file for complete search history.

(56) References Cited

U.S. PATENT DOCUMENTS 2,968,441 A * 1/1961 Holcomb ..... B05B 15/065 138/140
3,178,070 A * 4/1965 Leland ..... B65D 83/303 222/180
3,186,645 A * 6/1965 Eberlein ..... B65D 83/303 128/200.23
4,858,792 A * 8/1989 de Laforcade ..... B65D 83/205 222/402.1
4,941,600 A * 7/1990 Berriochoa ..... B65D 83/205 222/402.13
5,154,323 A * 10/1992 Query ..... B65D 83/205 222/153.11
5,529,226 A * 6/1996 Alberth, Jr. ..... B65D 83/303 222/402.1
6,464,110 B1 * 10/2002 Yamada ..... A45D 34/02 206/229
6,869,035 B2 * 3/2005 Doud ..... B65D 83/303 222/174
7,389,947 B2 * 6/2008 Denton ..... A61M 11/02 222/180
8,839,994 B2 * 9/2014 Mason ..... B65D 83/303 222/402.1
2004/0044303 A1 * 3/2004 Katz ..... B05B 11/0091 604/19
2004/0164102 A1 * 8/2004 Green ..... G01F 11/028 222/321.7

* cited by examiner

*Primary Examiner* — Vishal Pancholi
(74) *Attorney, Agent, or Firm* — Chun-Ming Shih

(57) ABSTRACT

A liquid ejection dispenser includes: a sleeve ring; and a tube, extending from one end of the sleeve ring. One end of the tube is provided with a liquid output end, while on an end surface of the sleeve ring is provided with a first positioning point and a second positioning point. In the sleeve ring is provided with a penetrating and trumpet shape hole, one end of the hole is in communication with the tube. As such, through fixing and sealing the sleeve ring on a press ejection head of a perfume bottle, and aligning the nozzle of the press ejection head with a position between the first positioning point and the second positioning point, in pressing down the press ejection head, the perfume in the perfume bottle will flow from the nozzle into a dispenser bottle.

6 Claims, 5 Drawing Sheets

LIQUID EJECTION DISPENSER

BACKGROUND OF THE INVENTION

1. Field of the Invention

The present invention relates to a liquid dispenser, and in particular to a liquid ejection dispenser, that can be sleeved on a press ejection head, such that when the press ejection head is pressed down, the liquid in a bottle can be ejected into a dispenser bottle, to realize liquid transfer and dispensing.

2. Description of the Related Art

In our daily life, on many occasions, perfume could add elegance to a person, and give a good impression to the people around. In order to make perfume portable and available to use, perfume has to be put into a smaller dispenser bottle for easy carriage.

Presently, in putting perfume into a smaller dispenser bottle, two approaches can be adopted. The first approach involves opening the perfume bottle, and then pouring the perfume directly into a dispenser bottle. For the second approach, refer to FIG. 1, wherein it shows that involves pulling a press ejection head 12 out from a pump water output port 11 of the perfume bottle 10, then placing a dispenser 13 on the pump water output port 11; subsequently, pressing down a press portion 15 of the dispenser 13, to press the perfume to flow into a dispenser bottle through a tube 14 located at a front end of the dispenser 13.

However, both the approaches mentioned above have their shortcomings. Firstly, in the first approach, since the volume of the dispenser bottle is small, thus its opening is small. Therefore, in the perfume pouring process, perfume may be leaked out and lost for not aiming accurately. Even worse, the perfume bottle openings for most of the brands are tight seal, such that the perfume bottle can not be opened. Secondly, in the second approach, the sizes and shapes of the pump water output ports 11 are different for the different brand perfume bottles presently available on the market, while the dispenser 13 is made of plastic not having elasticity. Therefore, in dispensing perfume, the press portion 15 can not be fixed to the pump water output port 11. In this case, a hand has to be used to hold the press portion 15 to press down onto and contact the pump water output port 11, as such perfume is liable to leak out. In operation, the dispenser 13 tends to drop down, thus causing quite inconvenience. Further, since the tube 14 is not pliable, such that in operation, the perfume bottle 10 and the dispenser bottle have to be tilted slightly, hereby leading to the risk of leakage. Moreover, in operation, a user has to use one hand to hold the perfume bottle 10 and the dispenser 13, and pressing down the dispenser 13; while using his other hand to hold the dispenser bottle, that is quite complicated and inconvenient. Besides, the dispenser 13 currently available on the market is obtained through putting the separate tube 14 and the press portion 15 together. Since the dispenser 13 is not formed integrally, gaps may exist between the tube 14 and the press portion 15, as such in dispensing operation, perfume tends to leak out through the gaps. In addition, for many perfume bottles, the press ejection head 12 is fixed on the bottle opening and can not be detached and pulled out, thus the dispenser 13 is not suitable for use. Or, even if the press ejection head 12 can be pulled out, it is damaged in the process and can not be used again. Finally, the size of pump water output port 11 can be varied with that of the perfume bottle 10, and since the dispenser 13 is not elastic, so it is not fit for use with various sizes of the pump water output ports 11. In case the size of the dispenser 13 is not fit for that of the pump water output port 11, pressing down the press portion 15 could cause oscillations of the perfume bottle 10, and that may lead to leakage and loss of perfume.

Presently, the price of perfume on the market ranges from tens to hundreds of US dollars, thus leakage and loss of perfume during dispensing could cause financial loss to the user; while perfume leaking on the user is also disturbing. As such, for the conventional perfume bottle, when the press ejection head is detached, it may be damaged and can not be used again.

Therefore, presently, the design and performance of the liquid dispenser is not quite satisfactory, and it leaves much room for improvement.

SUMMARY OF THE INVENTION

In view of the problems and drawbacks of the prior art, the present invention provides a liquid ejection dispenser, that is capable of dispensing perfume to a dispenser bottle, without the need to pull out the press ejection head, or tilt the perfume bottle to cause leakage and loss of perfume.

The major objective of the present invention is to provide a liquid ejection dispenser, which includes a sleeve ring and a tube. The sleeve ring is of a hollow ring shape, while on an inner wall of the sleeve ring is provided with a trumpet shape hole. The lager end of the hole is located near the inner wall of the sleeve ring, while the smaller end of the hole is in communication with the tube. At least an end face of the sleeve ring is provided with a first positioning point and a second positioning point. The distance between the first positioning point and the second positioning point is equal to the width of the hole near the inner wall of the sleeve ring. A liquid output end is provided at the other end of the tube. The liquid ejection dispenser can be formed by the sleeve ring and the tube integrally or through assembling the two pieces together.

The present invention provides a liquid ejection dispenser, its objective is to facilitate dispensing perfume to a dispenser bottle, while avoiding leakage or loss of perfume. In application, the sleeve ring of the liquid ejection dispenser is fixed onto the press ejection head on top of the perfume bottle. While the nozzle on the press ejection head is aligned with the hole of the sleeve ring by means of the first positioning point and the second positioning point. When the press ejection head is pressed down, the perfume in the perfume bottle will flow through a perfume conduit to the hole via the nozzle, and then the perfume will flow from the hole into the tube. And finally, the perfume will flow through a liquid output end of the tube into a dispenser bottle.

The present invention provides a liquid ejection dispenser, that is made of an elastic material. As such, in dispensing perfume, the press ejection head need not to be pulled out, instead a sleeve ring can be sleeved onto the press ejection head directly for the perfume bottles of various sizes. Through aligning the nozzle between the first positioning point and the second positioning point, the perfume ejected from the nozzle will flow precisely into the hole of the sleeve ring, and then flow into the dispenser bottle, to avoid leakage or loss of perfume. Since the liquid ejection dispenser is made of an elastic material, so it does not tend to move after being sleeved on the press ejection head of the perfume bottle. In this approach, a user may directly press down the press ejection head of the perfume bottle, to realize perfume dispensing easily.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detail descriptions.

DETAILED DESCRIPTION OF THE INVENTION

The purpose, construction, features, functions and advantages of the present invention can be appreciated and understood more thoroughly through the following detailed descriptions with reference to the attached drawings.

The First Embodiment

Figure 1:
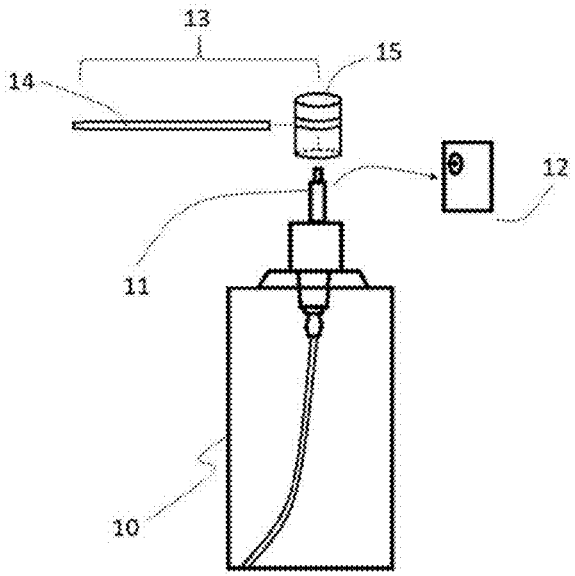
Fig. 1(Prior Art)
FIG. 1 is a schematic diagram of a perfume dispenser put on a perfume bottle according to the Prior Art.
Figure 2:
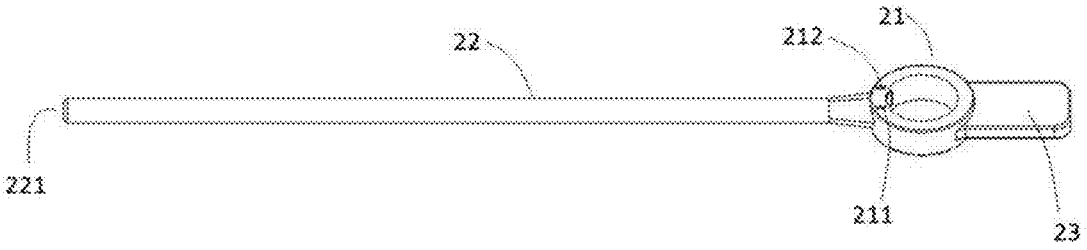
FIG. 2 is a schematic diagram of a liquid ejection dispenser according to a first embodiment of the present invention.
Figure 3:
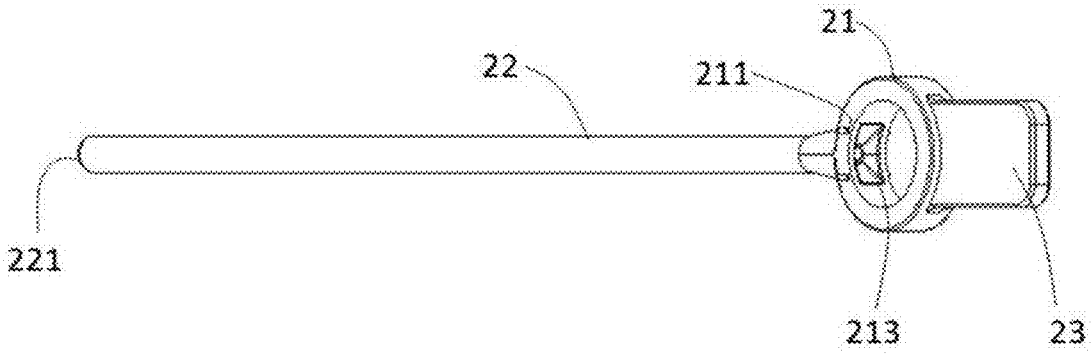
FIG. 3 is a schematic diagram of a liquid ejection dispenser viewed from another angle according to a first embodiment of the present invention.
Figure 4:
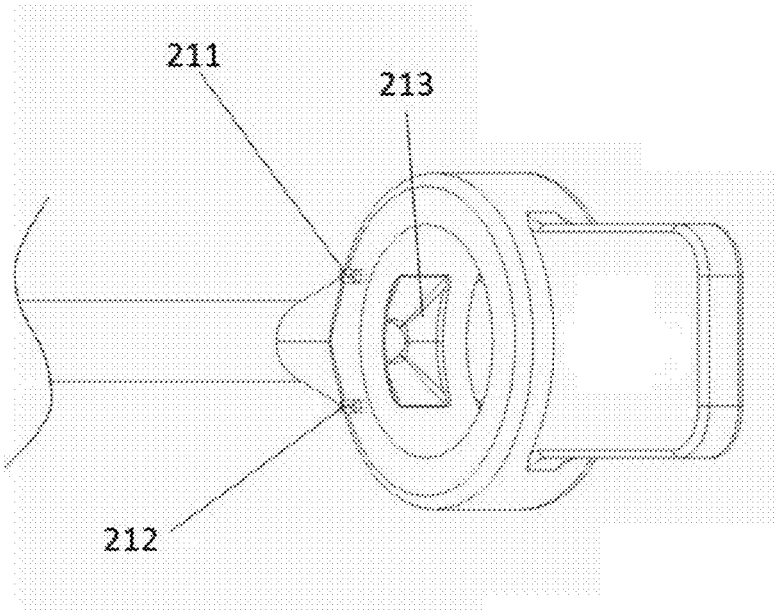
FIG. 4 is a partial enlarged view of FIG. 3.

Refer to FIGS. 2 to 4 respectively for a schematic diagram of a liquid ejection dispenser according to a first embodiment of the present invention; a schematic diagram of a liquid ejection dispenser viewed from another angle according to a first embodiment of the present invention; and a partial enlarged view of FIG. 3.

As shown in FIGS. 2 to 4, the present invention provides a liquid ejection dispenser, including a sleeve ring 21 and a tube 22. The sleeve ring 21 is made of an elastic material and is of a hollow ring shape. On an inner wall of the sleeve ring 21 is provided with a penetrating hole 213, in a shape of a trumpet, with its larger end located near the inner wall of the sleeve ring 21, and with its smaller end in communication with the tube 22. An end face of the sleeve ring 21 is provided with a first positioning point 211 and a second positioning point 212, while the other end face of the sleeve ring 21 is provided with another first positioning point 211 and another second positioning point 212, such that either end face can be used to achieve positioning. The distance between first positioning point 211 and a second positioning point 212 is the same as the width of the hole 213. The tube 22 is elastic, and is of a long and narrow shape, with its one end used as a sleeve end connecting to the sleeve ring 21, and is in communication with a smaller end of the hole 213. The portion of the tube 22 connecting the outer wall of the sleeve ring 21 is formed into a funnel shape, to strengthen the connection between the tube 22 and the sleeve ring 21, thus avoiding detaching of the tube 22 from the sleeve ring 21 due to frequent usage. The tube 22 and the sleeve ring 21 can be formed integrally into one piece, or the two elements can be formed together through assembly. A liquid output end 221 is provided at another end of the tube 22 facing away from the sleeve ring 21, while a handle 23 is provided on a side of the sleeve ring 21 opposite to the side connecting the tube 22.

Figure 5:
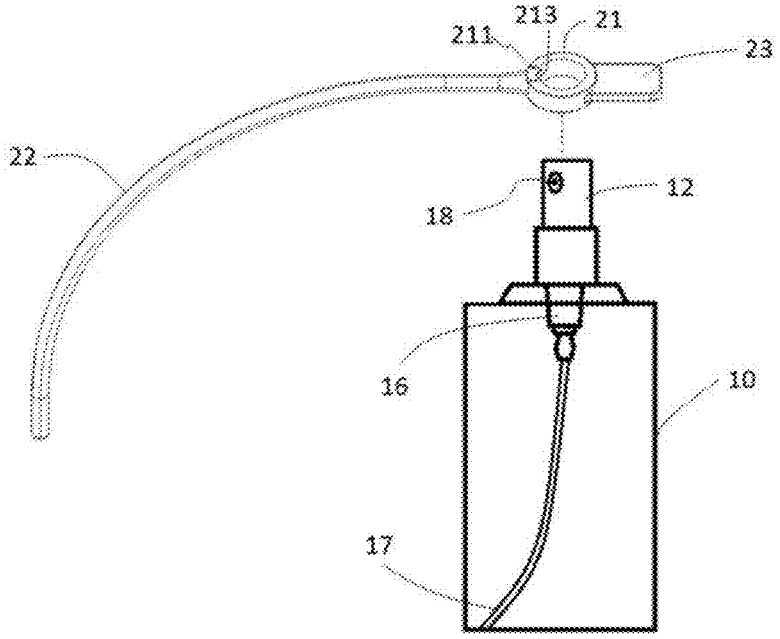
FIG. 5 is a schematic diagram of a liquid ejection dispenser in application according to a first embodiment of the present invention.
Figure 6:
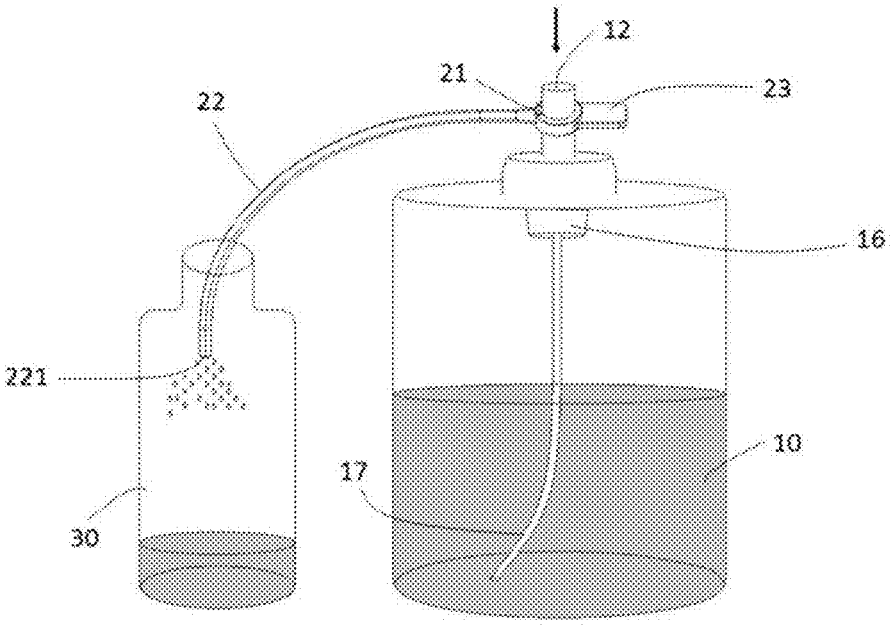
FIG. 6 is a schematic diagram of a liquid ejection dispenser in another application according to a first embodiment of the present invention.

Then refer to FIGS. 5 and 6 for a schematic diagram of a liquid ejection dispenser in application according to a first embodiment of the present invention; and a schematic diagram of a liquid ejection dispenser in another application according to a first embodiment of the present invention. As shown in FIGS. 5 and 6, in application, a user may use his hand to hole the tube 22 and the handle 23, to exert force to pull the sleeve ring 21 to open wide. Then, through elasticity, the sleeve ring 21 is contracted to fix and seal tightly on a press ejection head 12 of the perfume bottle 10; while the hole 213 of the sleeve ring 21 can be aligned with a nozzle 18 of the press ejection head 12 by means of the first positioning point 211 and the second positioning point 212. Since the hole 213 is of a trumpet shape, so when the press ejection head 12 is pressed downward, the pump 16 at the lower portion of the press ejection head 12 is made to compress the air, so that the perfume in the perfume bottle 10 will flow through the perfume duct 17 to eject out of the nozzle 18, and then flow into the hole 213. Since the hole 213 is of a trumpet shape, the perfume ejected into the hole 213 will flow into the tube 22 (refer to FIG. 4), and then flow into a dispenser bottle 30 through a liquid output end 221, thus completing the perfume dispensing. In the present invention, since the liquid ejection dispenser is made of an elastic material, so that when it is sleeved on the press ejection head 12, it is not liable to move. As such, a user may press directly on the press ejection head 12, to finish perfume dispensing easily. In this way, when the liquid ejection dispenser is sleeved onto the press ejection head 12, the hole 213 can be aligned with the nozzle 18 easily and precisely by means of the first positioning point 211 and the second positioning point 212, to avoid perfume being ejected out of the sleeve ring 21 to cause waste. Further, in the present invention, dispensing perfume or other liquids can be realized without the need to pull out the press ejection head 12, hereby saving time and effort.

The Second Embodiment

Figure 7:
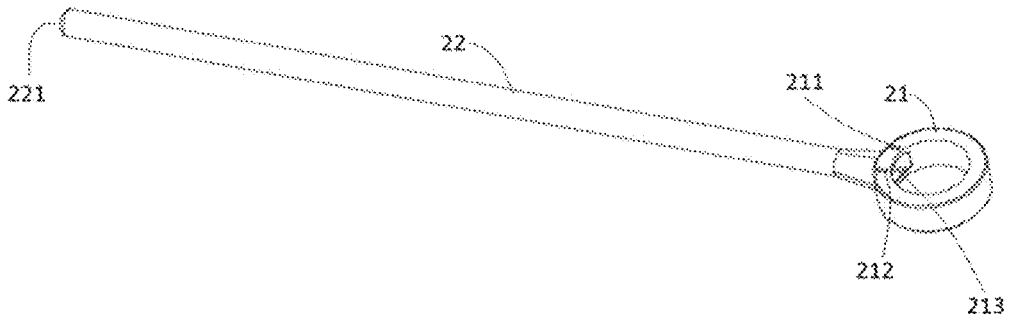
FIG. 7 is a schematic diagram of a liquid ejection dispenser according to a second embodiment of the present invention.

Refer to FIG. 7 for a schematic diagram of a liquid ejection dispenser according to a second embodiment of the present invention. As shown in FIG. 7, the rear end of the sleeve ring 21 is not provided with a handle 23. In application, as in the case of the first embodiment, the sleeve ring 21 is sleeved onto the press ejection head 12 of the perfume bottle 10. Through the positioning of the first positioning point 211 and the second positioning point 212, the hole 213 is aligned with the nozzle 18 of the press ejection head 12, to facilitate perfume dispensing (refer to FIGS. 5 and 6).

The Third Embodiment

Figure 8:
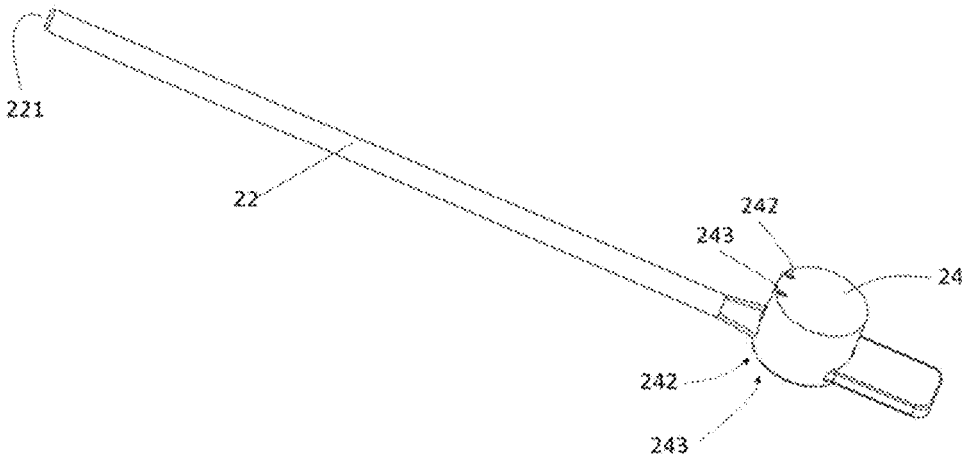
FIG. 8 is a schematic diagram of a liquid ejection dispenser according to a third embodiment of the present invention.
Figure 9:
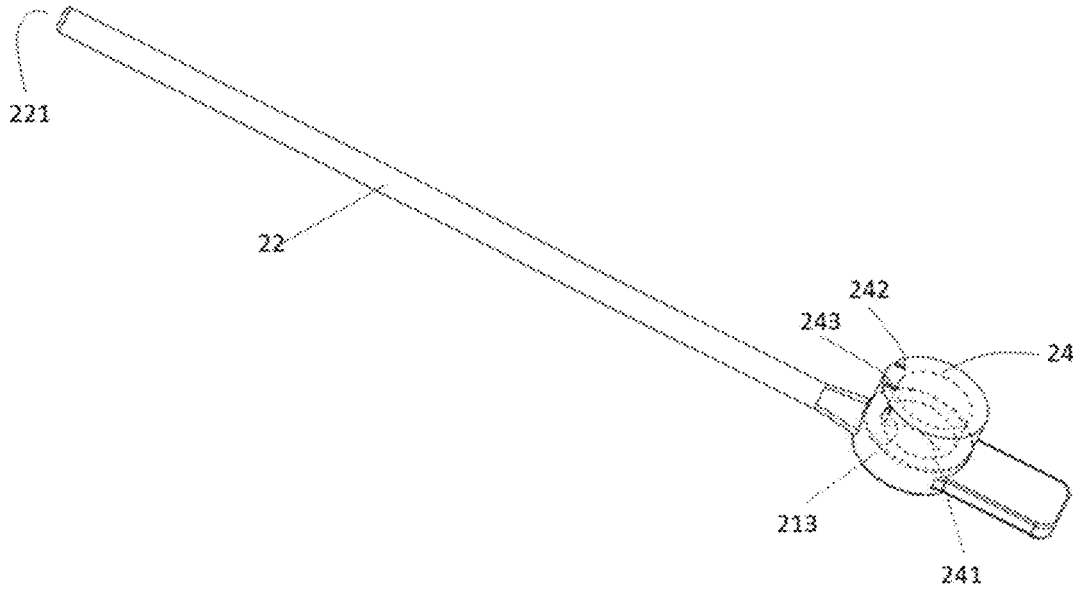
FIG. 9 is another schematic diagram of a liquid ejection dispenser according to a third embodiment of the present invention.
Figure 10:
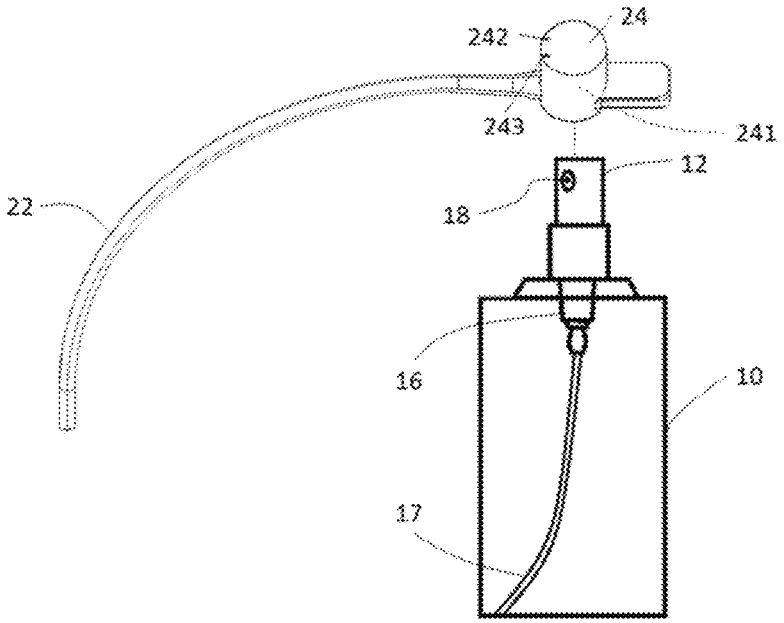
FIG. 10 is a schematic diagram of a liquid ejection dispenser in application according to a third embodiment of the present invention.

Refer to FIGS. 8 to 10 respectively for a schematic diagram of a liquid ejection dispenser according to a third embodiment of the present invention; another schematic diagram of a liquid ejection dispenser according to a third embodiment of the present invention; and a schematic diagram of a liquid ejection dispenser in application according to a third embodiment of the present invention. As shown in FIGS. 8 to 10, a seal end 24 is disposed extending upward on an end surface of the sleeve ring 21, and it contains a receiving room 241 inside. The top surface of the seal end 24 is provided with a first positioning point 242 and a second positioning point 243; while the bottom surface of the seal end 24 is provided with another first positioning point 242 and another second positioning point 243. In perfume dispensing, since the liquid ejection dispenser is made of an elastic material, the press ejection head 12 can be tightly sealed completely in the receiving room 241. When the seal end 24 is pressed down, it will bring the press ejection head 12 to move downward, the remaining perfume dispensing steps can be performed as the case in the first embodiment.

In applying the liquid ejection dispenser of the present invention, since the liquid ejection dispenser is made of elastic materials such as rubber, and silicon, thus the sleeve ring 21 is fit for use for any size of the press ejection head 12. Further, in the perfume dispensing process, there is no need to pull out the press ejection head 12. All it has to do is to align the nozzle 18 with a position between the first positioning point 211 and the second positioning point 212, to sleeve the liquid ejection dispenser on the press ejection head 12. In addition, the pliable tube 22 can be bent slightly into the dispenser bottle 30, and there is no need to tilt the perfume bottle 10 and the dispenser bottle 30, thus achieving perfume dispensing easily and avoiding leakage and loss of perfume.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A liquid ejection dispenser made of an elastic material, comprising:

an elastic tube, having a long and narrow shape, with its one end being a liquid output end, and its other end being a sleeve end;

an elastic sleeve ring, having a hollow and closed ring shape and being the sleeve end, used to sleeve onto a press ejection head of a perfume bottle, on an inner wall of the sleeve ring is provided with a hole in communication with the tube, the hole is of a trumpet shape, a lager end of the hole is opened toward the inner wall of the sleeve ring, while a smaller end of the hole is directly connected to the tube, at least an end face of the sleeve ring is provided with a first positioning mark and a second positioning mark, a distance between the first positioning mark and the second positioning mark is equal to a width of the hole near the inner wall of the sleeve ring; and a flat-plate handle, disposed on a side of the sleeve ring opposite to its side connecting the tube, such that a user holds the handle and the tube to exert force on and enlarge the sleeve ring, to sleeve the liquid ejection dispenser onto the press ejection head of the perfume bottle, wherein a portion of the tube connecting an outer wall of the sleeve ring is of a funnel shape, for strengthening its structure, to avoid breaking of the liquid ejection dispenser at the portion of connection due to frequent uses.

2. The liquid ejection dispenser as claimed in claim 1, further comprising: another first positioning mark and another second positioning mark, located on another end face of the sleeve ring, and opposite to the first positioning mark and the second positioning mark, such that in application, one of the two end faces is used to align a nozzle of the press ejection head with the hole by means of the first positioning mark and the second positioning mark.

3. The liquid ejection dispenser as claimed in claim 1, wherein the tube and the sleeve ring are formed integrally or separately.

4. The liquid ejection dispenser as claimed in claim 1, wherein a seal end, disposed on an end surface of the sleeve ring extending upward, for receiving the press ejection head of the perfume bottle.

5. The liquid ejection dispenser as claimed in claim 4, wherein the first positioning mark and the second positioning mark are provided on a top surface of the seal end; while another first positioning mark and another second positioning mark are provided on a bottom surface of the seal end.

6. The liquid ejection dispenser as claimed in claim 1, wherein liquid ejection dispenser is made of an elastic and corrosion resistant material.

* * * * *